US007575392B2

(12) United States Patent
Hagenah

(10) Patent No.: US 7,575,392 B2
(45) Date of Patent: Aug. 18, 2009

(54) CONCRETE-MOLDED STONE AND READY-TO-ASSEMBLE CONSTRUCTION MADE OF MOLDED STONES

(75) Inventor: Gerhard Hagenah, Worpswede (DE)

(73) Assignee: SF-Kooperation GmbH Beton-Konzepte, Bremen (DE)

( * ) Notice: Subject to any disclaimer, the term of this patent is extended or adjusted under 35 U.S.C. 154(b) by 0 days.

(21) Appl. No.: 11/872,493

(22) Filed: Oct. 15, 2007

(65) Prior Publication Data

US 2008/0047220 A1 Feb. 28, 2008

Related U.S. Application Data

(63) Continuation of application No. 10/490,710, filed as application No. PCT/EP02/09475 on Aug. 24, 2002, now abandoned.

(51) Int. Cl.
*E01C 5/06* (2006.01)

(52) U.S. Cl. ..... 404/39; 404/34; 404/35; 404/36

(58) Field of Classification Search ..... 404/34–37, 404/40–46

See application file for complete search history.

(56) References Cited

U.S. PATENT DOCUMENTS

| | | | | |
|---|---|---|---|---|
| 2,368,330 A | | 1/1945 | Schwartz | |
| 2,836,055 A | | 5/1958 | Shuman | |
| 2,920,846 A | | 1/1960 | Lingafelter | |
| 3,873,225 A | | 3/1975 | Jakobsen | |
| 4,030,729 A | | 6/1977 | Nathaniel | |
| 4,052,131 A | | 10/1977 | Lowrigkeit | |
| 5,267,810 A | | 12/1993 | Johnson | |
| 5,503,498 A | * | 4/1996 | Scheiwiller | 404/34 |
| 6,055,784 A | | 5/2000 | Geiger | |
| D434,857 S | * | 12/2000 | Scheiwiller | D25/113 |
| 6,250,850 B1 | | 6/2001 | Price et al. | |
| 6,455,127 B1 | * | 9/2002 | Valtanen | 428/137 |

FOREIGN PATENT DOCUMENTS

| | | |
|---|---|---|
| DE | 34 45 966 A1 | 8/1985 |
| DE | 3445866 | 7/1986 |
| DE | 4036444 | 5/1991 |
| DE | 9201491 | 7/1992 |
| DE | 94 00 895 U1 | 5/1994 |
| DE | 19733741 | 5/1998 |
| DE | 19937639 | 4/1999 |
| DE | 19816007 | 7/1999 |
| DE | 199 03 100 A1 | 8/2000 |
| DE | 199 25 350 | 12/2000 |
| DE | 19963964 | 7/2001 |

(Continued)

*Primary Examiner*—Raymond W Addie
(74) *Attorney, Agent, or Firm*—Laurence P. Colton; Smith Gambrell & Russell

(57) ABSTRACT

An essentially quadrate paving stone having a corresponding base block (21) is provided on all four side surfaces (25, 26) with flange-like, upright spacers (22) which are spaced apart from each other at intervals corresponding approximately to the width of the spacers, making it possible for them to make an interlocking connection with adjacent shaped paving stones of the same type. Furthermore, the bottom side (24) of the paving stone features a number of transverse, gutter-like depressions resulting in the formation of ribs between these depressions. This creates an additional dentification, or anchoring, in the bed surface of the installed paving stones.

17 Claims, 11 Drawing Sheets

FOREIGN PATENT DOCUMENTS

| | | | |
|---|---|---|---|
| EP | 0504536 | | 9/1992 |
| EP | 10 57 935 | A1 | 12/2000 |
| EP | 11 01 870 | A2 | 5/2001 |
| FR | 2779160 | | 12/1999 |
| WO | 99/54552 | A1 | 10/1999 |
| WO | WO 00 09808 | | 2/2000 |
| WO | PCT/EP01/11151 | | 9/2001 |

* cited by examiner

Fig. 1
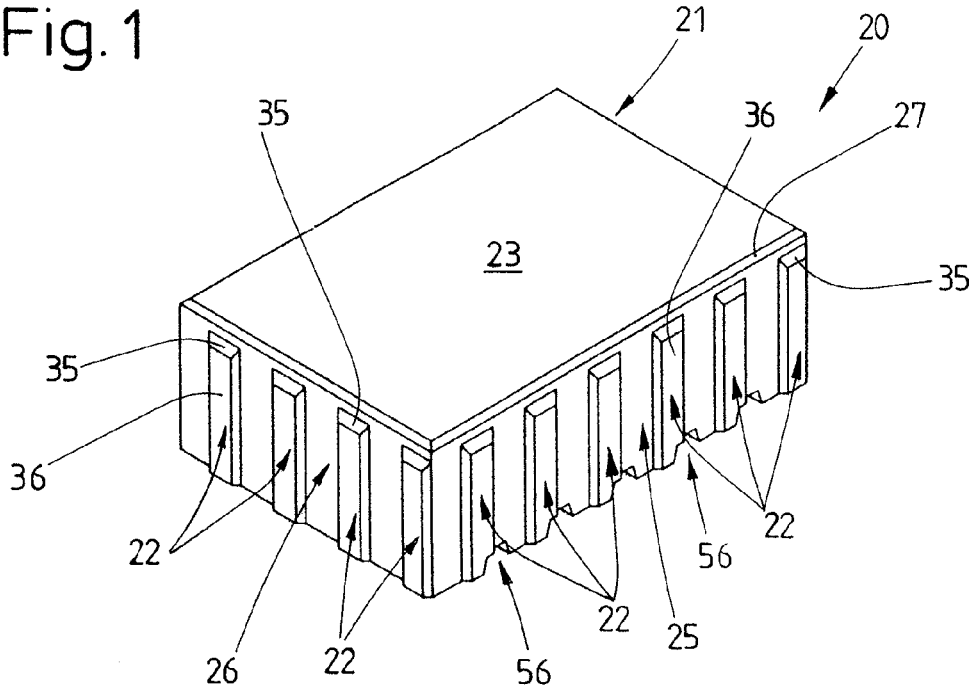
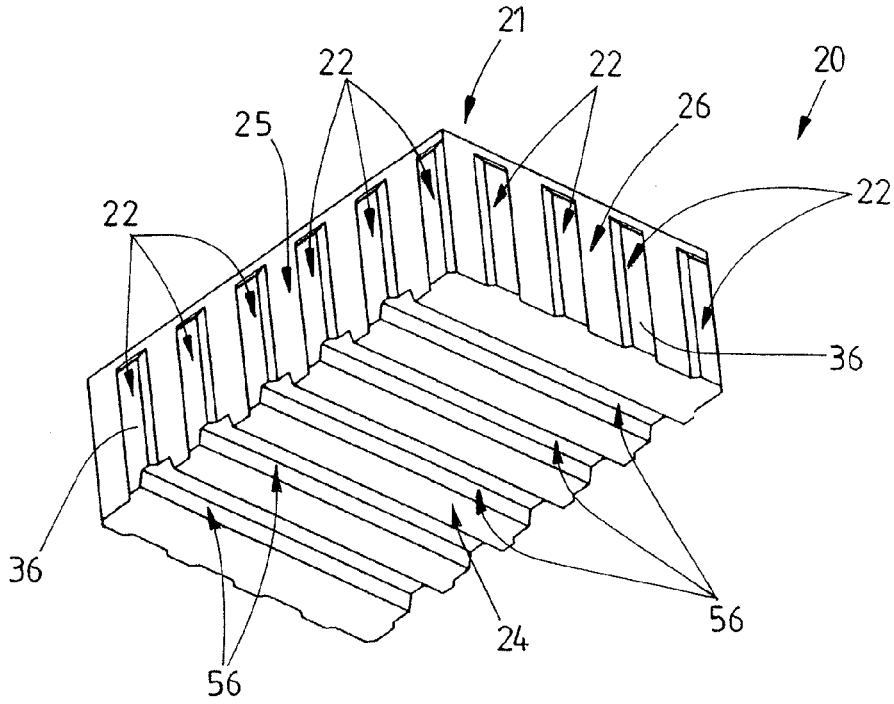
Fig. 2

Fig. 3
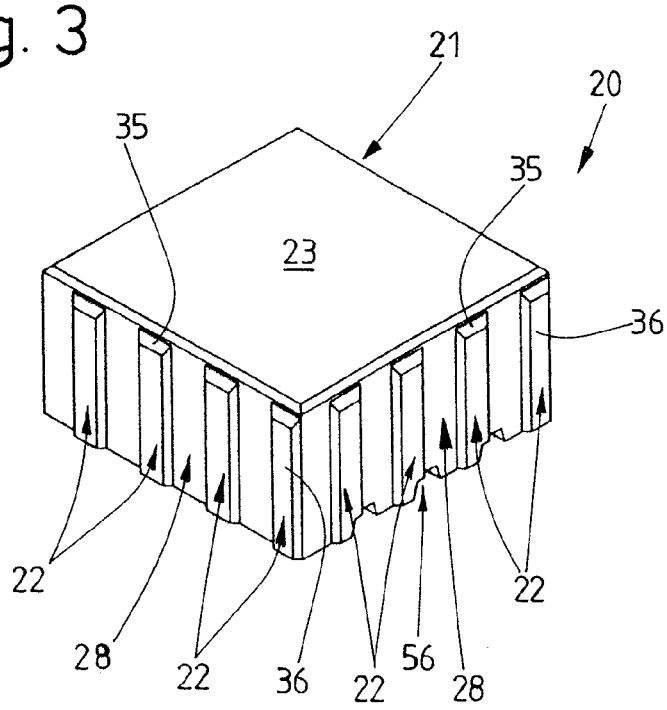
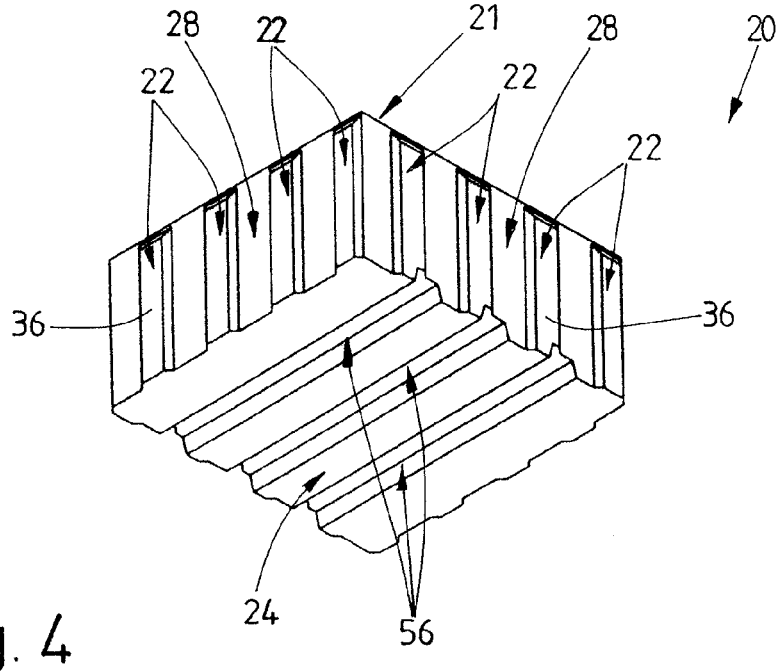
Fig. 4

CONCRETE-MOLDED STONE AND READY-TO-ASSEMBLE CONSTRUCTION MADE OF MOLDED STONES

STATEMENT OF RELATED APPLICATIONS

This patent application is a continuation application based on and claiming priority on U.S. patent application Ser. No. 10/490,710 having a filing date of 25 Oct. 2004 now abandoned, which is the United States of America Patent Cooperation Treaty (PCT) Chapter II National Phase application of PCT International Application No. PCT/EP02/09475 having an International Filing Date of 24 Aug. 2002 and which designates the United States of America, which in turn is based on and claims priority on German patent application 101 49 250.2 having a filing date of 5 Oct. 2001.

BACKGROUND OF THE INVENTION

The invention relates to shaped concrete paving stones for the installation of ground covers, in particular paving stones or paving slabs, with an essentially flat top side and bottom side as well as four vertical lateral sides, and with spacers at the side surfaces. The invention also relates to a kit comprising such shaped paving stones for pavements.

BRIEF SUMMARY OF THE INVENTION

For technical reasons involving production as well as to facilitate installation, it is desirable that paving stones exhibit a geometric shape, namely having a square or rectangular top side. On the other hand, the pavements formed by paving stones should be resistant to horizontal force components resulting from traffic loads.

The invention therefore is based on the object of providing shaped paving stones with a simple geometric configuration so that a pavement comprising such stones on a ground plane is resistant to horizontal load components.

To achieve this object the shaped paving stone according to the invention is characterized by the following features:

a) spacers are arranged at all four lateral surfaces, b) the spacers are arranged at the lateral surfaces in a regular grid pattern, c) the spacers are spaced at the same intervals on all lateral surfaces.

This "all-round denticulation" ensures that interlocking support is provided at all upright lateral sides of each paving stone using a plurality of spacers appropriately arranged with respect to the spacers of adjacent paving stones. Optimum or maximum stability is provided when the "all-round denticulation" is fixed to the pavement bed or ground plane in conjunction with an anchoring system on the underside of the paving stones. To this end, the invention has also provided for depressions to be formed in the underside of the paving stone, in particular transverse grooves having a trapezoidal cross-section. This creates the corresponding projections on the underside of the paving stone between the grooves, which are preferably spaced at identical intervals, namely ribs which likewise have a trapezoidal shape. The latter enter the roadbed (plane), thereby anchoring the paving stones. In conjunction with the invention's dentification of the lateral surfaces, this results in an optimal fixation of the pavement surface.

Despite the all-round dentification of the paving stones, their shape and size allow for the configuration of installation units of different structure, it being possible to lay adjacent paving stones of the same or different size offset to one another.

Further, advantageous details of the shaped paving stone according to the invention and its installation kit are provided in the dependent claims and in the remainder of this description.

BRIEF DESCRIPTION OF THE DRAWINGS

In the following, the preferred exemplary embodiments of the invention will be described in conjunction with the drawings, which show:

FIG. 1 is a shaped concrete paving stone in spatial representation.

FIG. 2 is a bottom view of the shaped paving stone from FIG. 1.

FIG. 3 is another shaped concrete paving stone in spatial representation.

FIG. 4 is a bottom view of the shaped paving stone from FIG. 2.

DETAILED DESCRIPTION OF THE PREFERRED EMBODIMENTS

Figure 5:
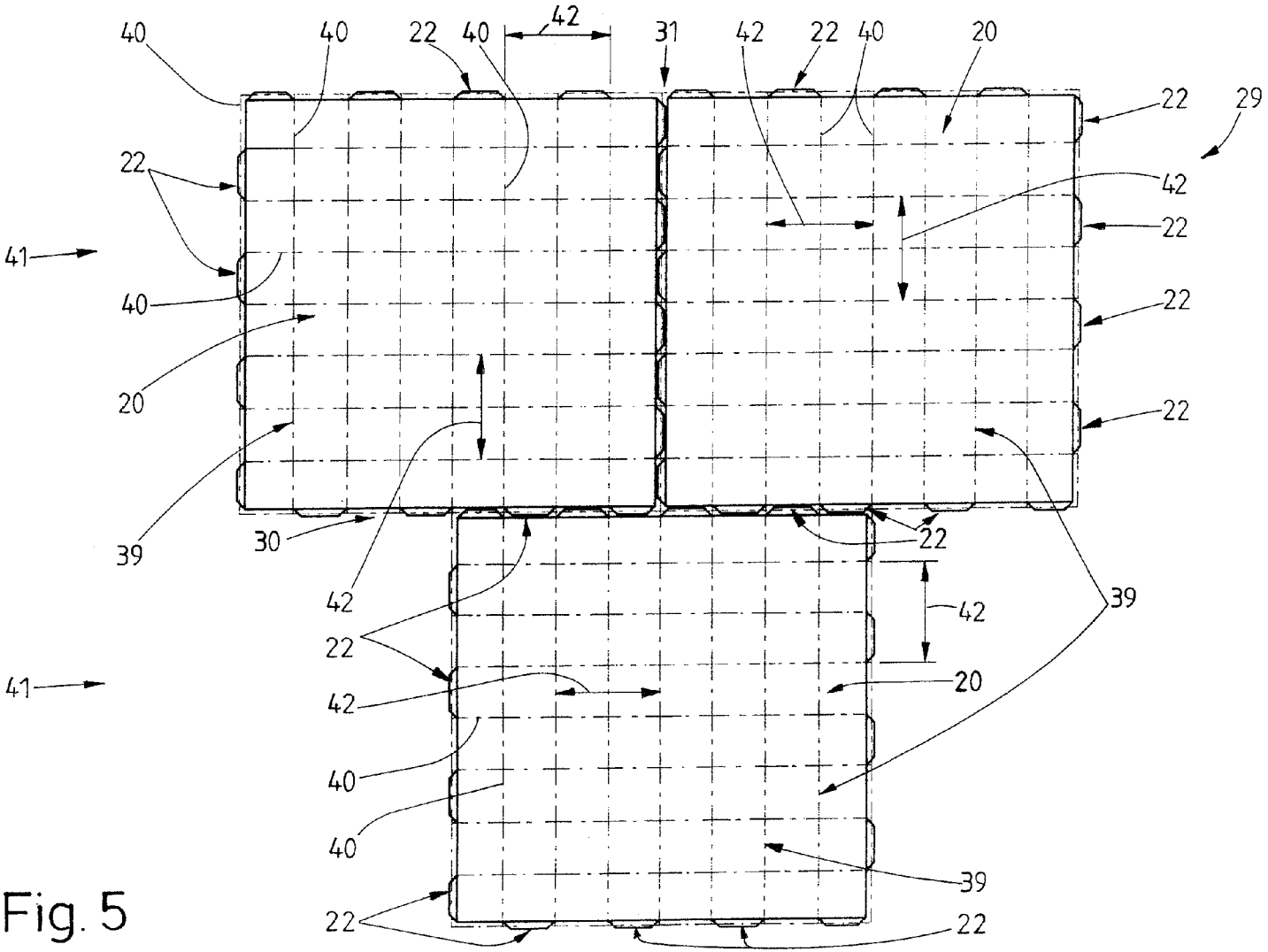
FIG. 5 is a top view of a ground cover of shaped paving stones pursuant to FIG. 3.
Figure 6:
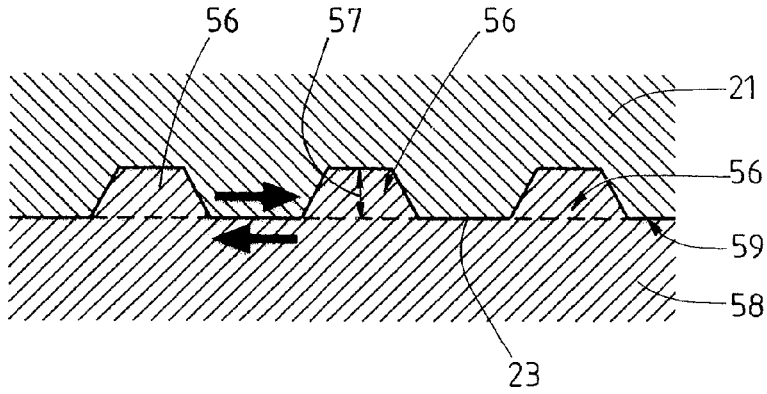
FIG. 6 is a vertical local section through a shaped paving stone pursuant to FIGS. 1 and 3.

The shaped paving stone pursuant to FIGS. 1 and 2, namely a paving stone 20, essentially comprises a base block 21 and spacers 22 at the sides of the base block 21. The base block 21 has a top side 23, which has an essentially horizontal orientation, and a bottom side 24 parallel thereto, as well as upright longitudinal side walls 25 and transverse side walls 26. The base block 21 has a rectangular layout and is provided with a surrounding chamfer 27 in the region of the top side 23. FIGS. 3 and 4 show another paving stone 20, which is configured as described above but which has a base block 21 with a rectangular layout with side walls 28 of equal length.

Figure 7:
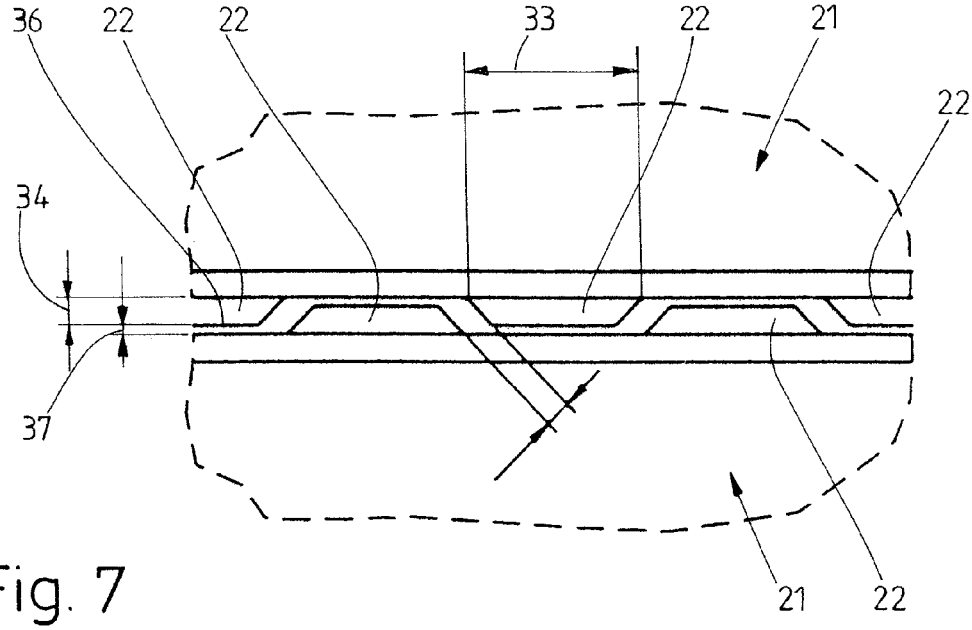
FIG. 7 is a vertical top view of a pavement cover of shaped stones pursuant to FIGS. 3 and 4 in the region of a joint in an enlarged scale.

The shown paving stones 20 can be deployed with other paving stones 20 to make a pavement cover 29. In the process of laying the stones, joints, namely longitudinal joints 30 and transverse joints 31, having a constant joint width 32 are formed between the paving stones 20. In order that an approximately constant joint width 32 is maintained when the paving stones 20 are laid, the base blocks 21 of the paving stones 20 have spacers 22 in the region of the upright side walls—namely longitudinal side walls 25, transverse side walls 26 or side walls 28. The circumference of paving stone 20 has spacers 22 on all four upright side walls 28 or longitudinal side walls 25 and transverse side walls 26. The paving stone has an identical number of spacers 22 of identical size and shape on its respective opposing side walls 28, or longitudinal side walls 25 and transverse side walls 26. The paving stone 20 pursuant to FIGS. 1 and 2 has six spacers 22 on each of the longitudinal side walls 25, while four spacers 22 are arranged on each of the transverse side walls 26. The paving stone 20 pursuant to FIGS. 3 and 4 exhibits four spacers 22 congruently on all four upright side walls 28. The spacers 22 in all paving stones 20 have the same form and the same dimensions. All spacers 22 are elongated, flange-like formations that continuously extend along the side walls from the bottom side 24 to slightly below the top side 23. The spacers 22 are somewhat trapezoidal in shape and exhibit an essentially constant width 33 and depth 34 along their entire length. In the transition of the spacers 22 to the side walls the top sides of the spacers are beveled, or provided with a chamfer 35. A visible side 36 of the spacer 22 runs approximately parallel to its respective side wall. The depth 34 of the spacers 22 corresponds approximately to the width of the joint 32 between adjacent paving stones 20. In this case the visible sides 36 of the spacers 22 of a paving stone 20 abut the side walls of an adjacent paving stone 20. After the paving stones 20 have been laid, the joints are filled with joint filler. The joint width 32 is preferably slightly larger than the depth 34 of the spacers 22. In this case the visible sides 36 of the spacers 22 do not abut the side walls of adjacent paving stones, with the result that joint filler is also located between these two surfaces (FIG. 7).

Figure 8:
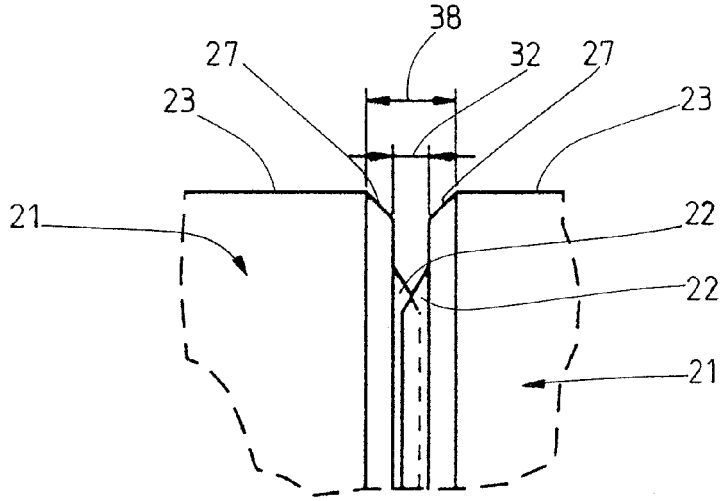
FIG. 8 is a side view of the region of the joint from FIG. 7.

Furthermore, the spacers 22 are used to produce a horizontal bond between adjacent paving stones 20 within a pavement cover 29. To this end the paving stones 20 are laid to form a pavement cover 29 in such a manner that each spacer 22 of a paving stone 20 fits between two adjacent spacers 22 of an adjacent paving stone 20. Here the width of 33 of a spacer 22 corresponds approximately to the distance between two adjacent spacers 22. However, the distance between adjacent spacers 22 is slightly greater, so that a certain amount of joint filler is assigned to the width of the joint between the contact surfaces of the spacers 22. As is the case in the region of the joints, the joint filler between the contact surfaces also serves to compensate for any dimensional inaccuracies in the supplied materials. In the paving stones 20 shown here, the depth 34 of the spacers 22 is approximately 3 mm and the joint width 32 is approximately 4 mm, so that there is an approximately 1 millimeter space 37 between the visible side 36 of the spacers and a facing side wall 25, 26, 28 of an adjacent paving stone 20. The horizontal space 38 between the base blocks 21 of adjacent paving stones 20 above the chamfer 27 is approximately 10 mm (FIGS. 7 and 8).

Figure 9:
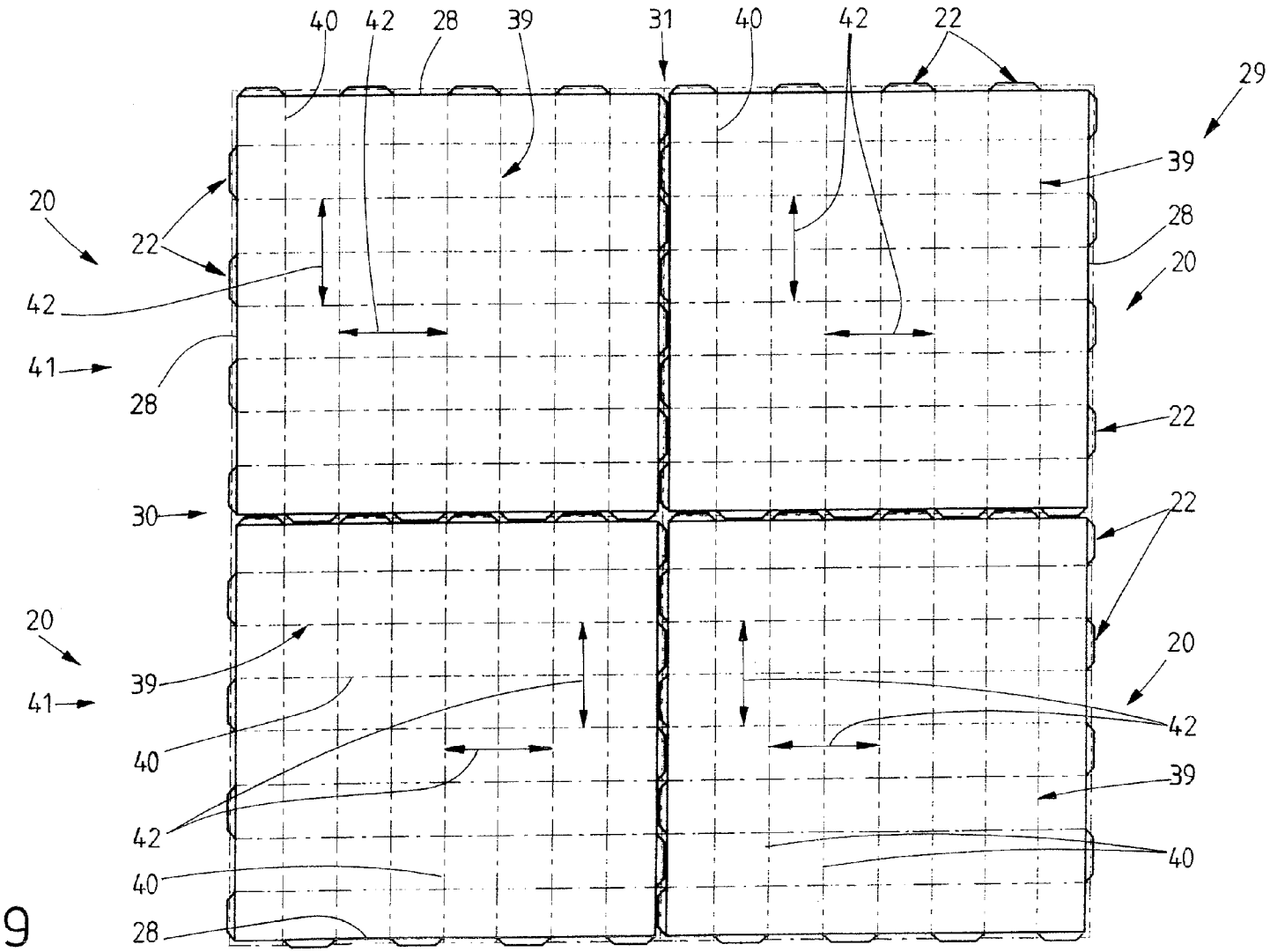
FIG. 9 is a top view of another pavement cover made of shaped paving stones pursuant to FIG. 3.
Figure 10:
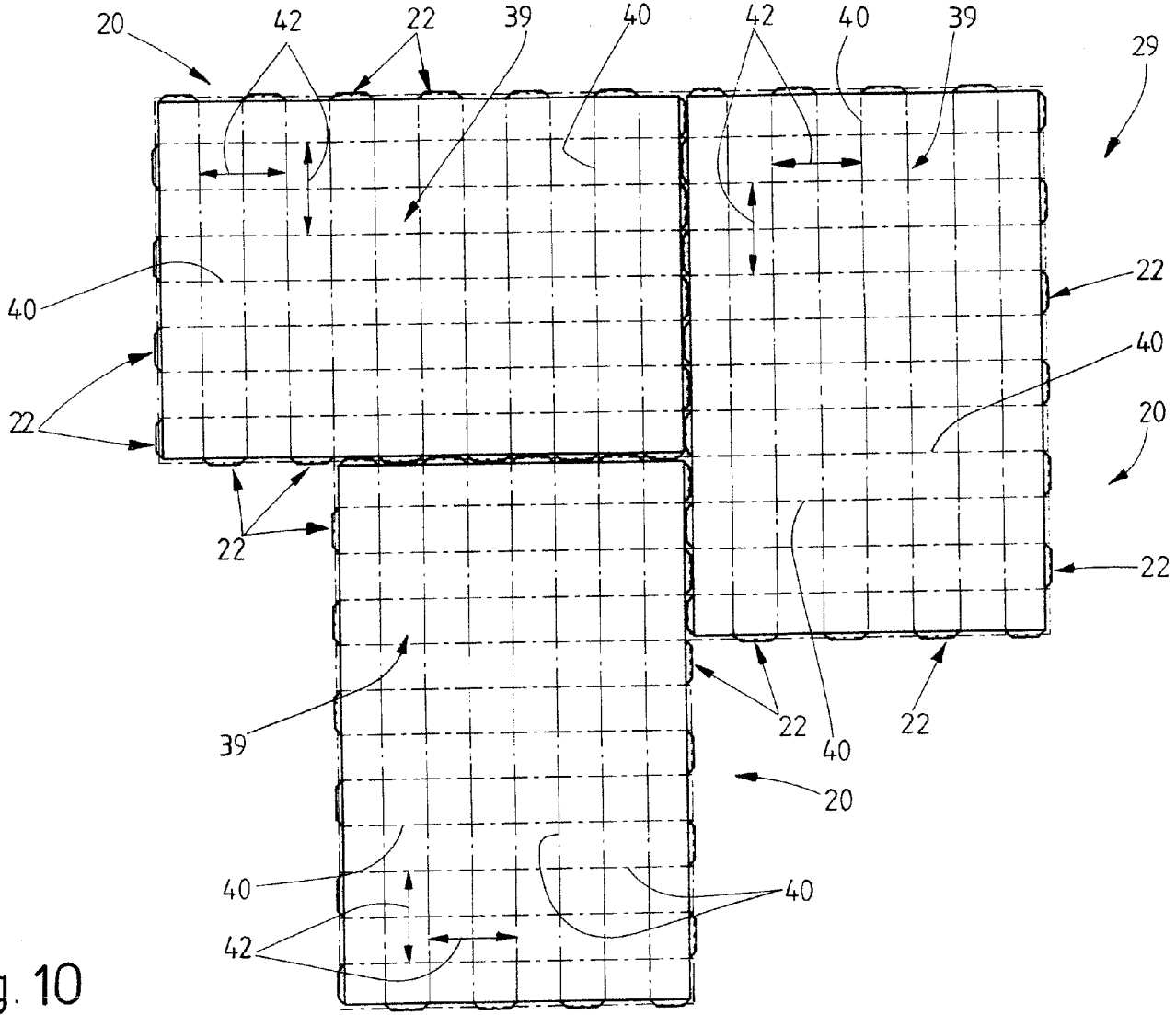
FIG. 10 is a top view of a pavement cover made of shaped paving stones pursuant to FIG. 3 in an angular composition.

One special feature concerning the positioning of the spacers 22 is that they are arranged in a uniform grid pattern 39 (FIG. 5). The measure between two grid lines 40 of the grid pattern corresponds approximately to the width 33 of a spacer 22. The parallel grid lines 40 are equidistant to one another in both the transverse and longitudinal direction of the paving stone 20. The overall width of the grid pattern 39 is determined by the distance from the middle of joint at a side wall 28 to the middle of the joint of the opposite side wall 28 of a paving stone 20. For paving stones 20 having a quadrate base block 21, the overall width of the grid pattern 39 in the longitudinal direction of the paving stone 20 corresponds to the overall width of the grid pattern 39 in the transverse direction of the paving stone 20. The spacers 22 on each side wall 28 are uniformly arranged between the grid lines 40, namely such that for a quadrate base block 21 all side walls 28 of the paving stone 20 have a congruent configuration when viewed from the side with respect to the position, number and arrangement of the spacers 22. Another special feature is that, when regarded in plan view, the spacers 22 of facing side walls 28 are respectively offset to one another, namely in gaps, with a spacer 22 of one side wall 28 immediately bordering the adjacent side wall 28. As shown in FIG. 5, this makes it possible to lay the paving stones 10 next to each other in continuous rows 41 in a half-brick bond, with a horizontal bond present not only between the paving stones 20 within a row 41 but also between adjacent rows 41. Here the spacers 22 of a paving stone 20 are joggled on all four side walls 28, i.e. completely circumferential, by spacers 22 of adjacent paving stones 20, thus ensuring continuous shifting prevention across the entire surface of the pavement cover 29 in the horizontal plane. FIG. 9 shows a second exemplary embodiment wherein a ground cover 29 is comprised of paving stones 20 having a square format. Here the rows of paving stones 41 are not arranged offset to each other but are laid out in continuous horizontal and vertical rows. FIG. 10 shows an exemplary embodiment of a ground cover 29 using paving stones 20 having a rectangular outline, arranged in what is known as a herringbone bond. In paving stones 20 having a rectangular outline, the two respective longitudinal side walls 25 and transverse side walls 26 opposite each other have the identical number and arrangement of spacers 22. In both cases, the spacers are situated in the same grid pattern 39 and in the same arrangement as in the previously described exemplary embodiment. It can be seen from FIGS. 9 and 10 that continuous shifting prevention is also ensured in these cases as well.

Another special feature can be seen in the illustrations pursuant to FIGS. 11 to 16, where paving stones 20 of various formats are laid out to form a number of unified ground covers. Here all paving stones 20 are configured in the manner described above, namely regarding the arrangement and configuration of the spacers and with exterior dimensions which correspond to a whole multiple of a grid unit, i.e. to the distance between two grid lines 40 pursuant to FIG. 5. This makes it possible to combine paving stones 20 of various sizes with each other while the spacers 22 on all four side walls 28 consistently interlock to ensure shifting prevention. Furthermore, there is also no need to cut individual paving stones 20 "to fit" in order to combine them with each other. A paving kit of paving stones 20 is provided in this manner having individual paving stones 20 which have in part varying configurations with respect to the format of the base block 21 but which otherwise fit into the grid pattern, in particular with respect to the size and arrangement of the spacers 22.

The starting point of the uniform grid pattern 39 is the distance from a first grid line 40 to the next parallel grid line 40 but one. This distance will hereinafter be referred to as the grid unit 42. A grid unit 42 corresponds approximately to the width 33 of a spacer 22 plus the distance between two adjacent spacers 22 (FIG. 5). All paving stones 20 of a kit for a contiguous ground cover exhibit a congruent grid unit 42. Possible measurements for the grid unit 42 could for example be 37.5 mm, 40 mm, 45 mm or 50 mm. The stones' dimensions would then correspond to a whole multiple of the grid unit. For example, for a grid unit 42 of 50 mm, stone dimensions of 100×100 mm, 100×200 mm, 200×200 mm etc. would be possible. The number of spacers 22 on each side wall 28, or longitudinal wall 25 and transverse side wall 26 result from the measure of the grid unit 42 and the length of the corresponding side walls 28, or longitudinal wall 25 and transverse side wall 26.

Figure 11:
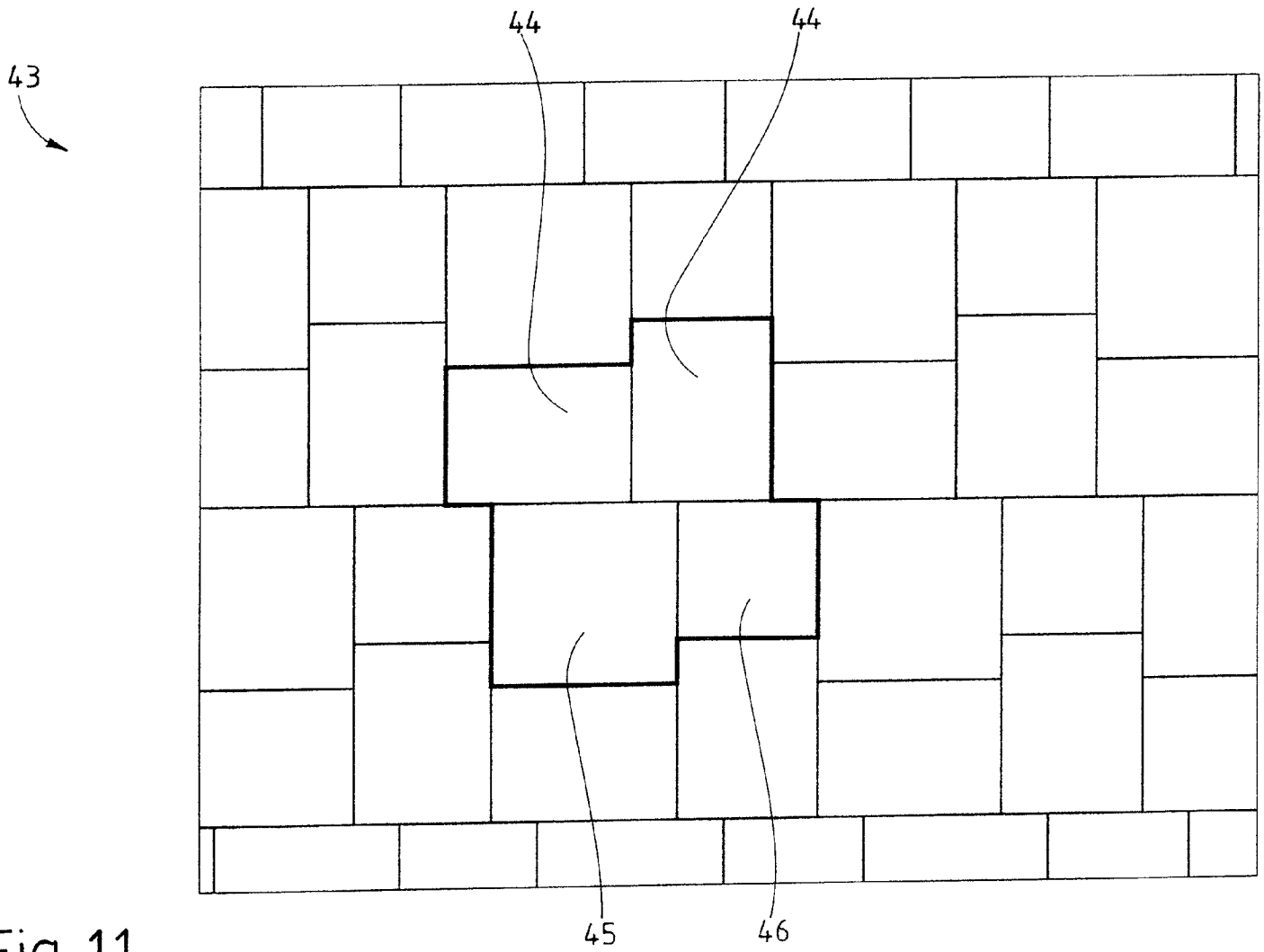
FIG. 11 is a top view of a pavement cover made of shaped stones having different horizontal dimensions.

FIG. 11 shows a ground cover 43 formed from a kit of paving stones 44, 45, 46 having different formats. The paver kit comprises three different types of stones, namely a rectangular paving stone 44 having format of 225×300 mm, a square paving stone 45 having a format of 300×300 mm and a square paving stone 46 having a format of 225×225 mm. Each of these three stone types are configured like the paving stone 20 pursuant to FIG. 5, namely provided with spacers 22 on all four side walls, the spacers being arranged in the grid pattern 39 as described above. Here all spacers 22 extending around all four sides of a paving stone 44, 45, 46 interlock with spacers 22 of adjacent paving stones 44, 45, 46 to form horizontal shifting prevention. The paving stones 44, 45, 46 can also be rotated with respect to one another without interrupting the mutual interlocking 22 between the spacers of adjacent paving stones 44, 45, 46.

Figure 12:
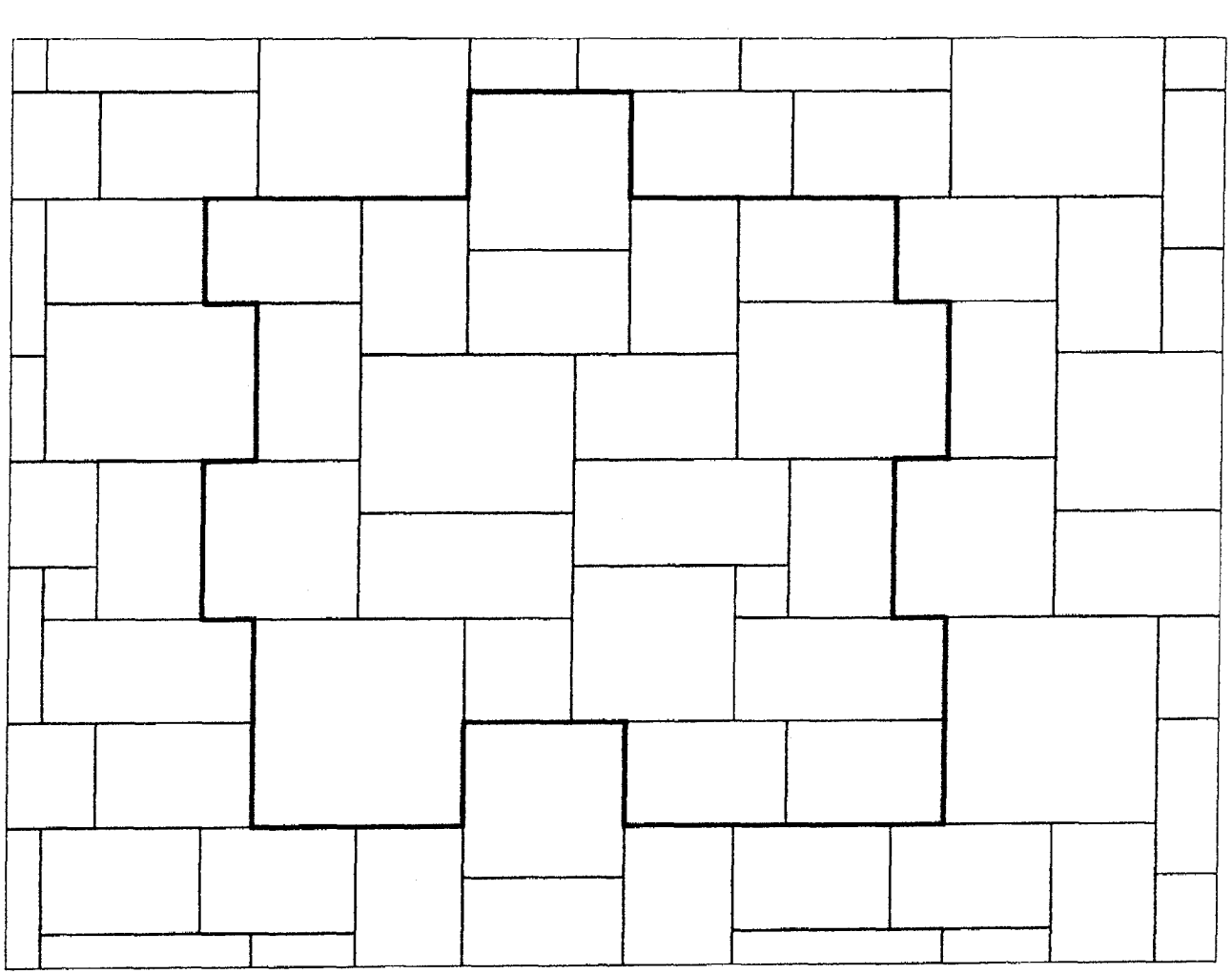
FIG. 12 is a schematic representation in top view of a pavement cover made of shaped stones having different horizontal dimensions in a Roman bond.

FIG. 12 shows another ground cover 43 which, like the aforementioned exemplary embodiment, is formed from a kit of paving stones 20 having different formats. In this case the paver kit comprises seven different stone types which for reasons of conciseness will not be described in more detail in the following. The individual stone types exhibit the following formats: 75×75 mm, 150×150 mm, 150×225 mm, 150×300 mm, 225×225 mm, 225×300 mm und 300×300 mm. The various stone types have been arranged in what is known as a "Roman bond" and are continuously interlocked with each other by means of the spacers 22.

Figure 13:
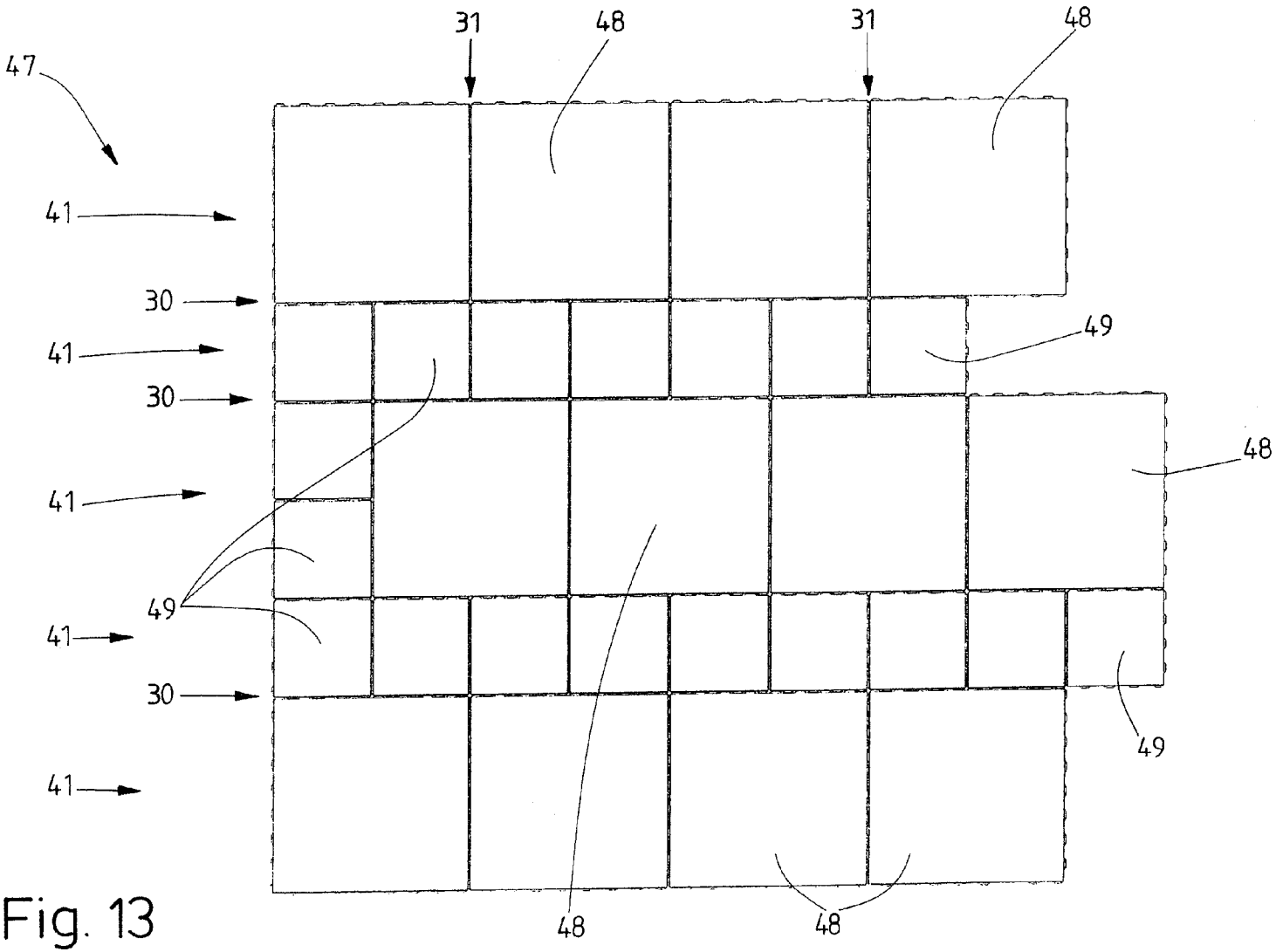
FIG. 13 is a schematic representation in top view of another pavement cover made of shaped paving stone with various horizontal dimensions.

FIG. 13 shows a ground cover 47 formed from paving stones 48, 49 having a square base block 21. Here two different stone types are used, namely a larger paving stone 48 having a stone size of 300×300 mm and a smaller paving stone 49 having a stone size of 150×150 mm. The latter paving stone thus has side walls 28 whose length is half as large as the corresponding dimension in the larger paving stone 48. Correspondingly, four smaller paving stones 49 arranged in a square exhibit the same outer dimensions as a larger paving stone 48. In the exemplary embodiment the paving stones 48, 49 are arranged in a geometric pattern, namely in rows 41. Some rows 41 comprise exclusively paving stones 48 or 49, other rows have both smaller as well as larger paving stones 48, 49. As before, all paving stones 48, 49 mutually interlock on all four side walls 28 by means of spacers 22.

Figures 14, 15:
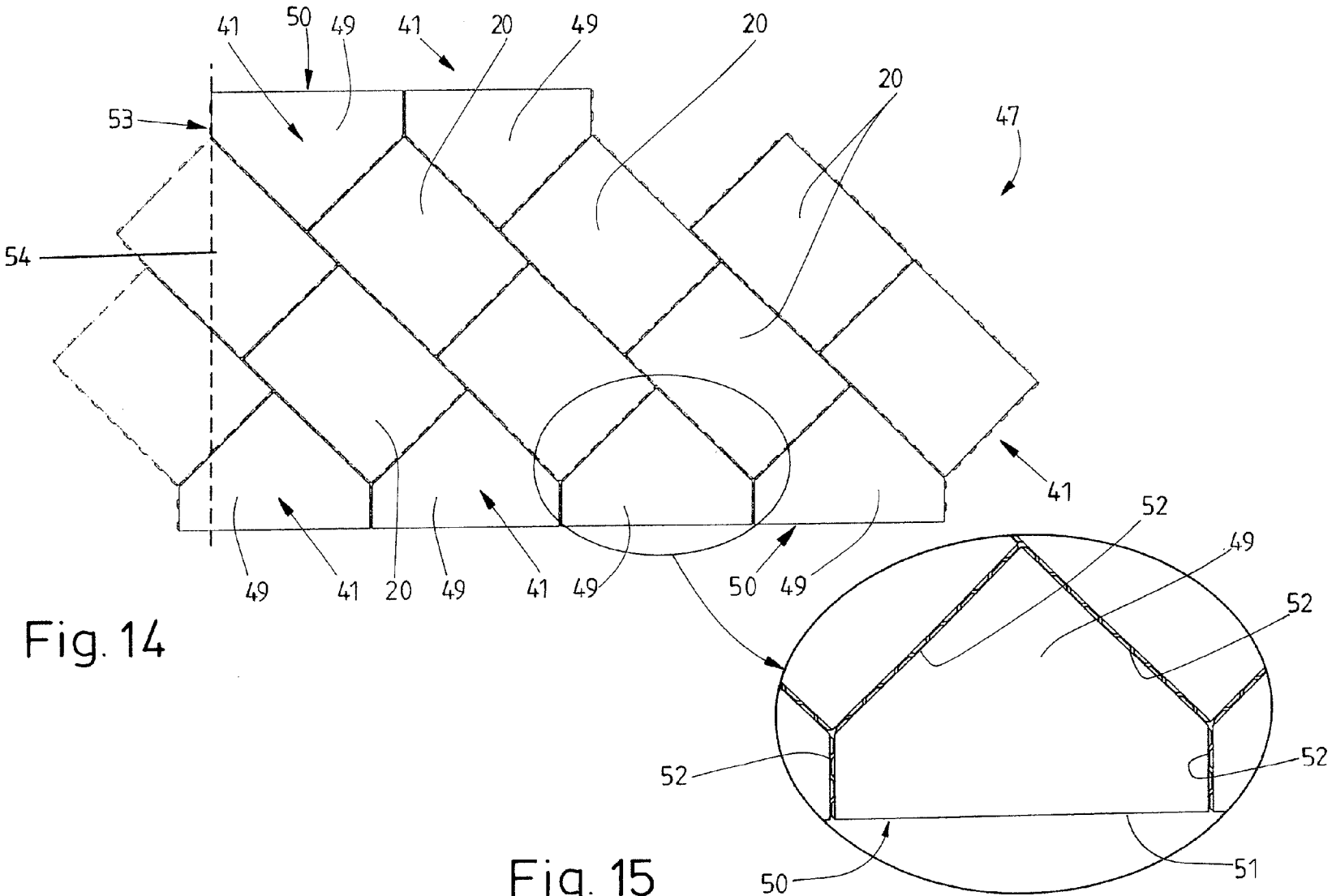
FIG. 14 is a top view of a pavement cover made of shaped stones laid with a slanted orientation.
FIG. 15 is a local view of the pavement cover from FIG. 14 in enlarged scale.

FIG. 14 shows a ground cover 47 composed of paving stones having a rectangular base block 21 and installed in continuous, oblique rows 41. Here each of the rows is arranged slightly offset to the other. For achieving a straight-edged margin, border stones 49 are arranged at the edge of the ground cover 47 (FIG. 15). A side wall 51 of the border stone 49 at the edge 50 of the ground cover 47 is free of spacers, while the other side walls 52, which face the adjacent paving stones 20 or border stones 49, do have spacers. These spacers are in turn arranged in the grid pattern 39 so that the border stones 49 are laid in a bond with the adjacent paving stones 20 and border stones 49. Each border stone 49 interlocks with the paving stones 20 of two adjacent (stone) rows and with two adjacent border stones 49. It is also possible to arrange the appropriate border stones 49 at another edge 53 which runs perpendicular to the edge 50. As an alternative, the paving stones 20, 49 can also be cropped along a cutting edge 54, as shown in the exemplary embodiment.

Figure 16:
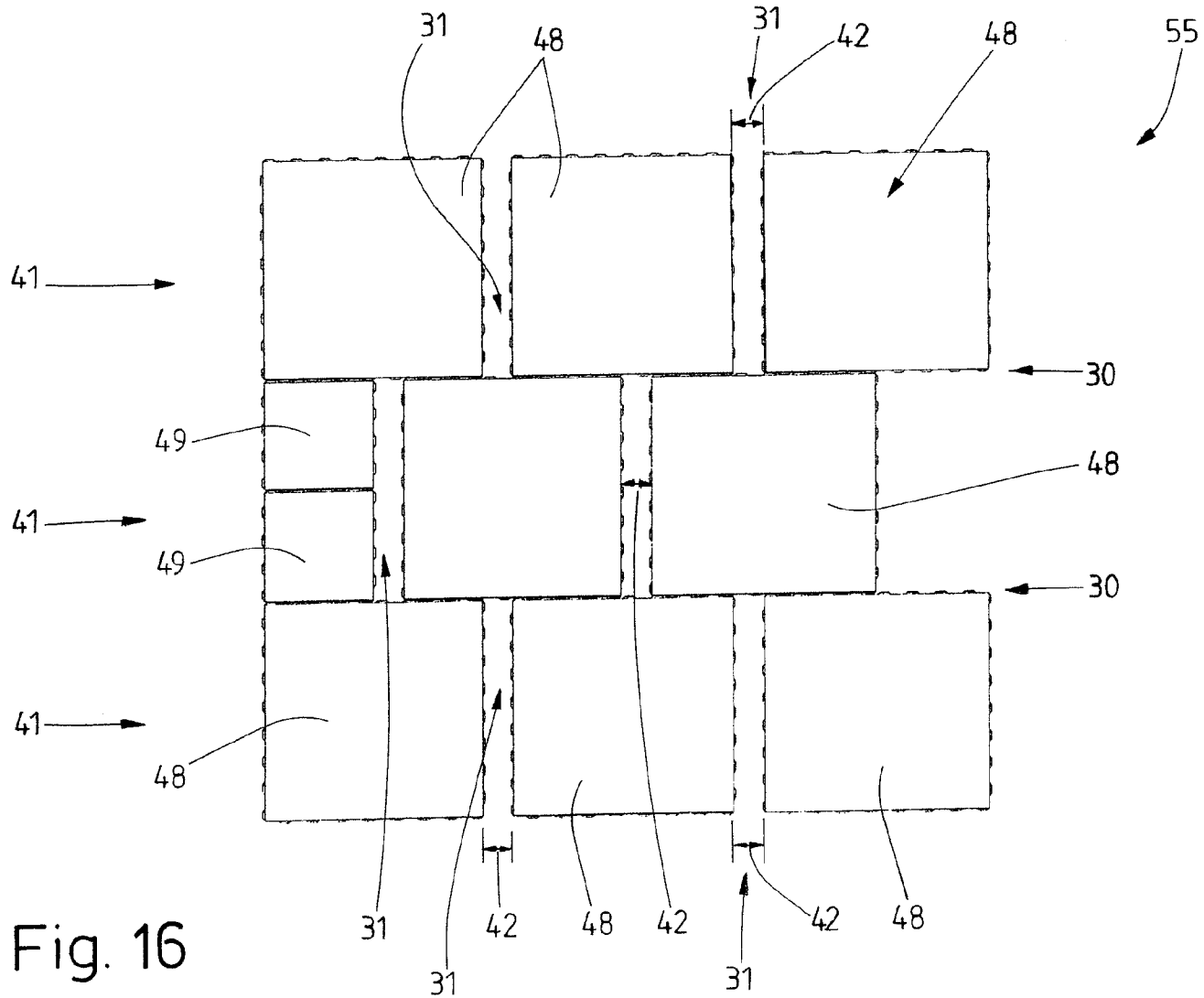
FIG. 16 is a top view of a pavement cover with grass grooves.

FIG. 16 shows a further example of a ground cover made of paving stones 20 installed with a turf joint. As can be seen in the exemplary embodiment of FIG. 13, the ground cover comprises two stone types, namely paving stones 48 and 49 which are laid in continuous rows 41. The special feature of this exemplary embodiment is that some joints exhibit a greater joint width 32 than other joints. In the present case the transverse joints 31 have a joint width 32 of 37.5 mm. The longitudinal joints 30 have, in agreement with the previous exemplary embodiments, a joint width 32 of approximately 10 mm. By virtue of this spacing in the transverse joints 31, turf joints are formed through which large amounts of precipitation are able to seep into the underlying ground surface. Furthermore, the turf joints can also be landscaped. When the paving stones 48, 49 are installed, adjacent paving stones 48, 49 of the same (stone) row 41 can be laid at a distance to one another, with the space shown in the exemplary embodiment corresponding exactly to the distance of one grid unit 42. This procedure results in the interlocking of the rows 41 with each other by means of the spacers 22 of the paving stones 48, 49 of the respective adjacent rows 41.

Another special feature, which is exhibited by all hitherto described paving stones 20, 44, 45, 46, 48, 49 as well as by the border stone 49 where applicable, is present in the formation of shifting prevention in the region of the bottom side 24. To this end, the paving stones 20, 44, 45, 46, 48, 49 have a number of depressions 56 on the bottom side 24. The depressions 56 are arranged parallel to each other and spaced at regular intervals. In paving stones having a rectangular base block 21, the depressions 56 run continuously from one longitudinal side wall 25 to the opposite longitudinal side wall 25; in paving stones having a square base block 21, they run analogously between two opposite side walls 28. The depressions 56 have an approximately trapezoidal cross-section and are cut into region of the bottom side 24 of the paving stones 20, 44, 45, 46, 48, 49 in the manner of a groove, resulting in corresponding projections at the bottom side 24 of the paving stones 20, 44, 45, 46, 48, 49 arranged between the equally-spaced grooves. The grooves and projections extend across the entire bottom side 24 of the paving stones 20, 44, 45, 46, 48, 49. The depth 57 of the depressions 56 is approximately 8 mm in a paving stone having a height of approximately 88 mm. The depressions 56 prevent a horizontal shifting of the paving stones 20, 44, 45, 46, 48, 49 on the pavement bed 58 since their configuration increases the coefficient of friction in the shear joint 59 between the bottom side 24 of the pavement stones 20, 44, 45, 46, 48, 49 and the pavement bed 58. The depressions 56 as seen in the view are slightly offset laterally to the respective spacers 22 so that the latter are slightly truncated by the depressions 56. Each bottom side 24 of the paving stones 20, 44, 45, 46, 48, 49 has one depression 56 less than the number of spacers 22 provided at the longitudinal side walls 25 or side walls 28.

By virtue of the spacers 22 at the upright side walls 25, 26, 28 and the depressions 56 in the region of the bottom side 24 of the paving stones 20, 44, 45, 46, 48, 49, the five side surface thus involved exhibit shifting prevention. The paving stones 20, 44, 45, 46, 48, 49 are interlocked to each other on all sides 20, 44, 45, 46, 48, 49 by means of the spacers 22 and also interlocked to the pavement bed 58 by means of the depressions 56. Through the arrangement of the spacers 22 in a uniform grid pattern 39 it is possible to lay paving stones 20, 44, 45, 46, 48, 49 having different outline dimensions with each other to create a ground cover without interrupting the interlocking bond. In this case as well, the paving stones 20, 44, 45, 46, 48, 49 interlock with each other in a practically "seamless" manner.

LIST OF DESIGNATIONS

20 paving stone 40 grid line
21 base block 41 row
22 spacer 42 grid unit
23 top side 43 ground cover
24 bottom side 44 paving stone
25 longitudinal side wall 45 paving stone
26 transverse side wall 46 paving stone
27 chamfer 47 ground cover
28 side wall 48 paving stone
29 ground cover 49 paving stone
30 longitudinal joint 50 edge
31 transverse joint 51 side wall
32 joint width 52 side wall
33 width 53 edge
34 depth 54 cutting edge
35 chamfer 55 ground cover
36 visible side 56 depression
37 space 57 depth
38 space 58 pavement bed
39 grid pattern 59 shear joint

What is claimed is:

1. A ground cover laid on a pavement bed, comprising paving stones (20, 44, 45, 46, 48, 49) each having an essentially flat top side (23), a bottom side (24), four upright sides, spacers (22) arranged continuously around the four upright sides (25, 26, 28) in a regular grid pattern (39), and shifting prevention devices on the four upright sides (25, 26, 28) and the bottom side, wherein:

a) the spacers (22) of one of the paving stones are arranged to engage in an offset manner to the spacers (22) of a neighboring paving stone;

b) the shifting prevention devices on the bottom side (24) are a plurality of depressions (56) that interlock with the pavement bed (58) and that extend continuously from one of the upright sides (25, 26, 28) to another of the upright sides (25, 26, 28);

c) the bottom side (24) has projections between the depressions (56) extending across the entire bottom side (24);

d) the depression (56) are arranged parallel to one another and are spaced at equal distances from one another;

e) the spacers (22) have a flange shaped, trapezoidal cross-section and have a constant width (33) and depth (34), are arranged in a regular grid pattern, and are spaced at the same intervals on the upright sides (25, 26, 28); and f) the paving stones are laid on the pavement bed in a continuously interlocked manner such that one of the four upright sides of one of the paving stones abuts one of the four upright sides of the neighboring paving stone.

2. The ground cover according to claim 1, wherein one of the spacers (22) of each of the four upright sides is placed directly at an upright corner or edge of the paving stone and another one of the spacers (22) is arranged at an opposite upright corner or edge of the paving stone and is separated from the opposite upright edge by a space corresponding to the distance between two adjacent spacers (22).

3. The ground cover according to claim 1, wherein the depressions (56) are separated from one another by a space that corresponds approximately to one grid unit (42), spaced at equal intervals from one of the four upright sides (26).

4. The ground cover according to claim 1, wherein the depressions (56) are laterally offset to the spacers (22) such that the spacers (22) are partially truncated by the depressions (56).

5. The ground cover according to claim 1, wherein an identical number of the spacers (22) are arranged at each of the four upright sides (25, 26, 28).

6. The ground cover according to claim 2, wherein the distance between the two adjacent spacers (22) arranged on one of the four upright (25, 26, 28) corresponds approximately to the width of the spacer (22).

7. The ground cover according to claim 1, wherein all of the spacers are identical in dimension and shape.

8. The ground cover according to claim 1, wherein all of the spacers extend essentially across the entire height of the paving stones, proceeding from the bottom side (24) and ending at a slight distance from the top side (23).

9. A ground cover laid on a pavement bed, comprising paving stones (20, 44, 45, 46, 48, 49) each having an essentially flat top side (23), a bottom side (24), four upright sides, spacers (22) arranged continuously around the four upright sides (25, 26, 28) in a regular grid pattern (39), and shifting prevention devices on the four upright sides (25, 26, 28) and the bottom side, wherein:

a) the spacers (22) of one of the paving stones are arranged to engage in an offset manner to the spacers (22) of a neighboring paving stone and one of the spacers (22) of each of the four upright sides is placed directly at an upright corner or edge of the paving stone and another one of the spacers (22)is arranged at an opposite upright corner or edge of the paving stone and is separated from the opposite upright edge by a space corresponding to the distance between two adjacent spacers (22);

b) the shifting prevention devices on the bottom side (24) are a plurality of depressions (56) that interlock with the pavement bed (58) and that extend continuously from one of the upright sides (25, 26, 28) to another of the upright sides (25, 26, 28) and the depressions (56) are separated from one another by a space that corresponds approximately to one grid unit (42), spaced at equal intervals from one of the four upright sides (26);

c) the bottom side (24) has projections between the depressions (56) extending across the entire bottom side (24);

d) the depression (56) are arranged parallel to one another and are spaced at equal distances from one another and the depressions (56) are laterally offset to the spacers (22) such that the spacers (22) are partially truncated by the depressions (56);

e) the spacers (22) have a flange shaped, trapezoidal cross-section and have a constant width (33) and depth (34), are arranged in a regular grid pattern, and are spaced at the same intervals on the upright sides (25, 26, 28); and f) the paving stones are laid on the pavement bed in a continuously interlocked manner such that one of the four upright sides of one of the paving stones abuts one of the four upright sides of the neighboring paving stone.

10. The ground cover according to claim 9, wherein an identical number of the spacers (22) are arranged at each of the four upright sides (25, 26, 28).

11. The ground cover according to claim 9, wherein the distance between the two adjacent spacers (22) arranged on one of the four upright (25, 26, 28) corresponds approximately to the width of the spacer (22).

12. The ground cover according to claim 9, wherein all of the spacers are identical in dimension and shape.

13. The ground cover according to claim 9, wherein all of the spacers extend essentially across the entire height of the paving stones, proceeding from the bottom side (24) and ending at a slight distance from the top side (23).

14. A ground cover laid on a pavement bed, comprising paving stones (20, 44, 45, 46, 48, 49) each having an essentially flat top side (23), a bottom side (24), four upright sides, spacers (22) arranged continuously around the four upright sides (25, 26, 28) in a regular grid pattern (39), and shifting prevention devices on the four upright sides (25, 26, 28) and the bottom side, wherein:

a) the spacers (22) of one of the paving stones are arranged to engage in an offset manner to the spacers (22) of a neighboring paving stone and one of the spacers (22) of each of the four upright sides is placed directly at an upright corner or edge of the paving stone and another one of the spacers (22) is arranged at an opposite upright corner or edge of the paving stone and is separated from the opposite upright edge by a space corresponding to the distance between two adjacent spacers (22), with the distance between the two adjacent spacers (22) corresponding approximately to the width of the spacer (22);

b) the shifting prevention devices on the bottom side (24) are a plurality of depressions (56) that interlock with the pavement bed (58) and that extend continuously from one of the upright sides (25, 26, 28) to another of the upright sides (25, 26, 28) and the depressions (56) are separated from one another by a space that corresponds approximately to one grid unit (42), spaced at equal intervals from one of the four upright sides (26);

c) the bottom side (24) has projections between the depressions (56) extending across the entire bottom side (24);

d) the depression (56) are arranged parallel to one another and are spaced at equal distances from one another and the depressions (56) are laterally offset to the spacers (22) such that the spacers (22) are partially truncated by the depressions (56);

e) the spacers (22) have a flange shaped, trapezoidal cross-section and have a constant width (33) and depth (34), are arranged in a regular grid pattern, and are spaced at the same intervals on the upright sides (25, 26, 28); and f) the paving stones are laid on the pavement bed in a continuously interlocked manner such that one of the four upright sides of one of the paving stones abuts one of the four upright sides of the neighboring paving stone.

15. The ground cover according to claim 14, wherein an identical number of the spacers (22) are arranged at each of the four upright sides (25, 26, 28).

16. The ground cover according to claim 15, wherein all of the spacers extend essentially across the entire height of the paving stones, proceeding from the bottom side (24) and ending at a slight distance from the top side (23).

17. The ground cover according to claim 16, wherein all of the spacers are identical in dimension and shape.

* * * * *